US006601257B1

(12) United States Patent
Felix-Flender et al.

(10) Patent No.: US 6,601,257 B1
(45) Date of Patent: Aug. 5, 2003

(54) JEWELRY BRUSH WITH CLEANING ZONES

(75) Inventors: Cheryl Felix-Flender, Bedford, MA (US); Karl William Kaltenbach, Newtonville, MA (US); Ward A. Fritz, Waltham, MA (US)

(73) Assignee: Connoisseur Products Corp., Woburn, MA (US)

( * ) Notice: Subject to any disclaimer, the term of this patent is extended or adjusted under 35 U.S.C. 154(b) by 0 days.

(21) Appl. No.: 09/416,877

(22) Filed: Oct. 13, 1999

Related U.S. Application Data

(60) Provisional application No. 60/104,242, filed on Oct. 14, 1998.

(51) Int. Cl.[7] ..... A46B 9/02

(52) U.S. Cl. ..... 15/160; 15/DIG. 5; 15/167.1; 401/129; D4/134

(58) Field of Search ..... 15/160, 167.1, 15/184, 207.2, DIG. 5; 401/129; D4/104, 116, 134

(56) References Cited

U.S. PATENT DOCUMENTS

| | | | | | |
|---|---|---|---|---|---|
| 560,663 | A | * | 5/1896 | Wallas | 15/167.1 |
| 608,365 | A | * | 8/1898 | Goehring | 15/160 |
| 890,143 | A | * | 6/1908 | Kuzzer | 15/167.1 |
| 1,062,961 | A | * | 5/1913 | Funcke | 401/129 X |
| 1,452,108 | A | * | 4/1923 | Carter | 15/167.1 |
| 1,963,389 | A | | 6/1934 | Vardeman | 15/188 |
| 2,099,688 | A | | 11/1937 | Hill et al. | 300/21 |
| 2,250,112 | A | | 7/1941 | Larson | 15/207.2 X |
| 2,397,757 | A | | 4/1946 | Schwedersky | 15/160 X |
| 2,429,740 | A | * | 10/1947 | Aufsesser | 15/167.1 |
| 2,432,264 | A | | 12/1947 | Tyler | 15/207.2 |
| 2,558,334 | A | | 6/1951 | Baumgartner | 15/207.2 |
| 2,633,591 | A | * | 4/1953 | Servilla | 15/160 |
| 2,738,529 | A | * | 3/1956 | Bernet | 15/160 X |
| 2,834,344 | A | | 5/1958 | Kanai | 15/167.1 X |
| 3,047,898 | A | | 8/1962 | Levite | 15/207.2 |
| 3,087,223 | A | | 4/1963 | Raw | 15/207.2 X |
| 3,133,546 | A | | 5/1964 | Dent | 15/207.2 X |
| 3,180,342 | A | | 4/1965 | Dietsche | 132/120 |
| 4,360,940 | A | * | 11/1982 | Smith | 15/160 |
| 4,519,111 | A | | 5/1985 | Cavazza | 15/167.1 |
| 4,570,282 | A | | 2/1986 | Kaufman et al. | 15/167.1 |
| 4,610,045 | A | | 9/1986 | Rauch | 15/167.1 |
| 4,617,694 | A | | 10/1986 | Bori | 15/167.1 |
| 4,776,054 | A | | 10/1988 | Rauch | 15/167.1 |
| 4,800,608 | A | | 1/1989 | Key | 15/167.1 |
| 4,894,880 | A | | 1/1990 | Aznavoorian | 15/167.2 |
| 4,961,717 | A | | 10/1990 | Hickey | 446/76 |
| 5,040,260 | A | | 8/1991 | Michaels | 15/167.1 |

(List continued on next page.)

FOREIGN PATENT DOCUMENTS

| | | | | |
|---|---|---|---|---|
| CA | 2040222 | * | 9/1992 | 15/167.1 |
| DE | 1139096 | * | 11/1962 | 15/167.1 |
| EP | 199835 | * | 11/1986 | 15/DIG. 5 |
| FR | 1123465 | * | 10/1960 | 15/167.1 |
| FR | 2624360 | * | 6/1989 | 15/167.1 |
| GB | 891114 | * | 3/1962 | 15/167.1 |

*Primary Examiner*—Mark Spisich
(74) *Attorney, Agent, or Firm*—Valarie B. Rosen; Choate, Hall & Stewart

(57) ABSTRACT

A jewelry brush that exhibits improved jewelry cleaning and includes a plurality of bristles divided into at least two zones. Each zone has characteristics including a surface profile directed to cleaning a particular jewelry profile. The characteristics include modified bristle length, material characteristics, angle, grouping and grouping shape. Additional embodiments of the invention may further include additional zones of bristles trimmed with additional surface profiles. In addition, the brush can be constructed to include a bottle cap in the handle portion, allowing the jewelry brush to be include and retained in a bottle that itself may contain cleaning fluids.

3 Claims, 7 Drawing Sheets

U.S. PATENT DOCUMENTS

| | | | | | |
|---|---|---|---|---|---|
| 5,046,213 | A | | 9/1991 | Curtis et al. | 15/167.1 |
| 5,065,470 | A | | 11/1991 | Diamond | 15/106 |
| D330,286 | S | * | 10/1992 | Curtis et al. | D4/104 |
| D334,472 | S | * | 4/1993 | Curtis et al. | D4/104 |
| 5,201,092 | A | | 4/1993 | Colson | 15/167.1 |
| 5,274,873 | A | | 1/1994 | Shields | 15/167.1 |
| 5,305,489 | A | | 4/1994 | Lage | 15/167.1 |
| 5,325,560 | A | | 7/1994 | Pavone et al. | 15/106 |
| 5,335,389 | A | | 8/1994 | Curtis et al. | 15/167.1 |
| 5,345,647 | A | | 9/1994 | Liu | 15/207.2 |
| 5,355,546 | A | | 10/1994 | Scheier et al. | 15/167.2 |
| 5,371,915 | A | | 12/1994 | Key | 15/167.1 |
| 5,392,483 | A | | 2/1995 | Heinzelman et al. | 15/167.1 |
| 5,396,678 | A | | 3/1995 | Bredall et al. | 15/167.1 |
| 5,398,367 | A | | 3/1995 | Lu | 15/167.1 |
| 5,398,368 | A | | 3/1995 | Elder | 15/167.1 |
| D358,712 | S | | 5/1995 | Loew | D4/104 |
| 5,419,001 | A | | 5/1995 | Wan | 15/167.1 |
| D359,851 | S | | 7/1995 | Loew | D4/104 |
| 5,459,899 | A | | 10/1995 | Bauer | 15/167.1 |
| D364,740 | S | | 12/1995 | Loew | D4/104 |
| 5,483,722 | A | | 1/1996 | Scheier et al. | 15/167.2 |
| D368,803 | S | | 4/1996 | Yost et al. | D4/104 |
| D370,347 | S | | 6/1996 | Heinzelman et al. | D4/104 |
| 5,528,786 | A | | 6/1996 | Porat et al. | 15/22.1 |
| D372,584 | S | | 8/1996 | Yost et al. | D4/104 |
| D374,350 | S | | 10/1996 | Yost et al. | D4/104 |
| D374,775 | S | | 10/1996 | Yost et al. | D4/104 |
| 5,570,487 | A | | 11/1996 | Schneider | 15/167.1 |
| 5,604,951 | A | | 2/1997 | Shipp | 15/167.1 |
| 5,628,082 | A | | 5/1997 | Moskovich | 15/110 |
| 5,655,249 | A | | 8/1997 | Li | 15/167.1 |
| D386,905 | S | | 12/1997 | Brady et al. | D4/104 |
| D391,083 | S | | 2/1998 | Nicoll | D4/104 |
| 6,141,818 | A | * | 11/2000 | Weihrauch | 15/167.1 |

* cited by examiner

JEWELRY BRUSH WITH CLEANING ZONES

This application claims priority to U.S. Provisional Application No. 60/104,242, filed Oct. 14, 1998.

FIELD OF THE INVENTION

The present invention relates generally to jewelry cleaning brushes and more particularly to brushes having bristles grouped as tufts and divided into zones, with each zone configured to clean a particular type or shape of jewelry.

BACKGROUND OF THE INVENTION

Jewelry is currently cleaned by a variety of methods, including commercial jewelry cleaning liquids, steam cleaners, ultrasonic cleaners, boiling, aqua ammonia, and mechanical polishing. Commercial cleaning fluids typically include a small brush to aid in cleaning the jewelry. These small jewelry cleaning brushes are principally of a design employing a one-by-seven or two-by-seven tuft layout. In other words, these brushes are simply arranged in one or two straight rows (respectively) of seven tufts, trimmed with a flat top. Each tuft itself contains multiple single strands or filaments that are themselves either straight or crimped. Crimped strands are stiffer and create a different feel as compared to straight strands.

The reality is that most jewelry pieces provide a varied, multi-contoured surface profile. Chains present a flat or rounded cross section, rings present both rounded cross sections and highly detailed mount area and earrings can present an arbitrary shape. But flat trimmed tuftel brushes have difficulty in naturally conforming to such varied jewelry surfaces, ultimately requiring the user to spend considerable time cleaning. Thus, the prior art jewelry brushes are not optimal forjewelry cleaning because they do not account for the wide variation in jewelry surfaces and thus fail to provide a mechanism to clean multiple surface profiles.

One solution is to fabricate the bristles of a pliable material greatly increasing bristle flex thus allowing the brush to conform better to the jewelry surface. But this solution may require the user to exert additional force during brushing to conform the bristles to the surface, often causing the uncontrolled distribution of cleaning fluid in the area as each bristle springs away from the jewelry surface. In addition, over time the bristles would remain in their flexed configuration or would break off and embed themselves in the jewelry.

Thus, it is a goal of the present invention to provide a jewelry brush with improved cleaning capabilities.

It is an additional goal of the present invention to provide a jewelry brush capable of cleaning multiple surface profiles.

It is a further goal of the present invention to provide a jewelry brush capable of cleaning a variety of different jewelry pieces.

It is a goal of the present invention to provide an improved jewelry brush including a mechanism to store the brush with a cleaning solution.

These and other objectives will become evident from the following:

SUMMARY OF THE INVENTION

In accordance with one aspect of the present invention, a jewelry brush is provided which exhibits improved jewelry cleaning. The jewelry brush includes a plurality of bristles divided into at least two zones with preferred embodiments utilizing three zones. Each zone has characteristics directed to cleaning a particular jewelry profile. The characteristics include modified bristle length, material characteristics, angle, grouping and grouping shape.

In one embodiment of the invention, the brush comprises a shaft have a shaft axis, the shaft being divided into a handle portion and a head portion. The head portion has a tope surface and a bottom surface, with a plurality of bristles secured to the top surface. The bristles are divided into at least two zones, the first zone being located at the end of the head away from the handle. The first zone is composed of a either a single large bristle or a plurality of bristles forming one or more tufts, mounted at an angle such that the angle between the shaft axis and the bristle as measured from the handle side of the bristles is greater than 90 degrees. The bristles in the first zone may also be trimmed to present a rounded or flat contour at the top. The first zone bristles are shaped so as to facilitate cleaning small, detailed jewelry surfaces.

The second zone is composed of multiple groups of bristles mounted at substantially right angles to the shaft axis and located proximally to the first zone and toward the handle portion. The second zone bristles are adapted to clean a gemstone mounting or rounded jewelry portion. The second zone bristles are trimmed to provide an indented cup surface contour, allowing a gem stone mount to nestle within the bristles. This zone may be formed from two concentric ovals of tufts trimmed so as to create a concave cup.

In additional embodiments of the invention, the jewelry brush further includes a third zone of bristles mounted at substantially right angles to the shaft and located proximally to the second zone and toward the handle portion. The third zone bristles are adapted to clean an elongated jewelry profile, such as that presented by a chain. The third zone bristles are trimmed to provide an indented channel surface contour, allowing a chain or bar portion to nestle within the bristles.

Additional embodiments of the invention may further include additional zones of bristles trimmed with additional surface profiles. In addition, the brush can be constructed to include a bottle cap in the handle portion, allowing the jewelry brush to be include and retained in a bottle that itself may contain cleaning fluids.

BRIEF DESCRIPTION OF THE DRAWINGS

While the specification concludes with claims which particularly point our and distinctly claim the invention, it is believed the present invention will be batter understood from the following description of several particular embodiments taken in conjunction with the accompanying drawings, in which like reference numerals identify similar elements and wherein:

DETAILED DESCRIPTION OF THE PREFERRED EMBODIMENTS

Figure 1:
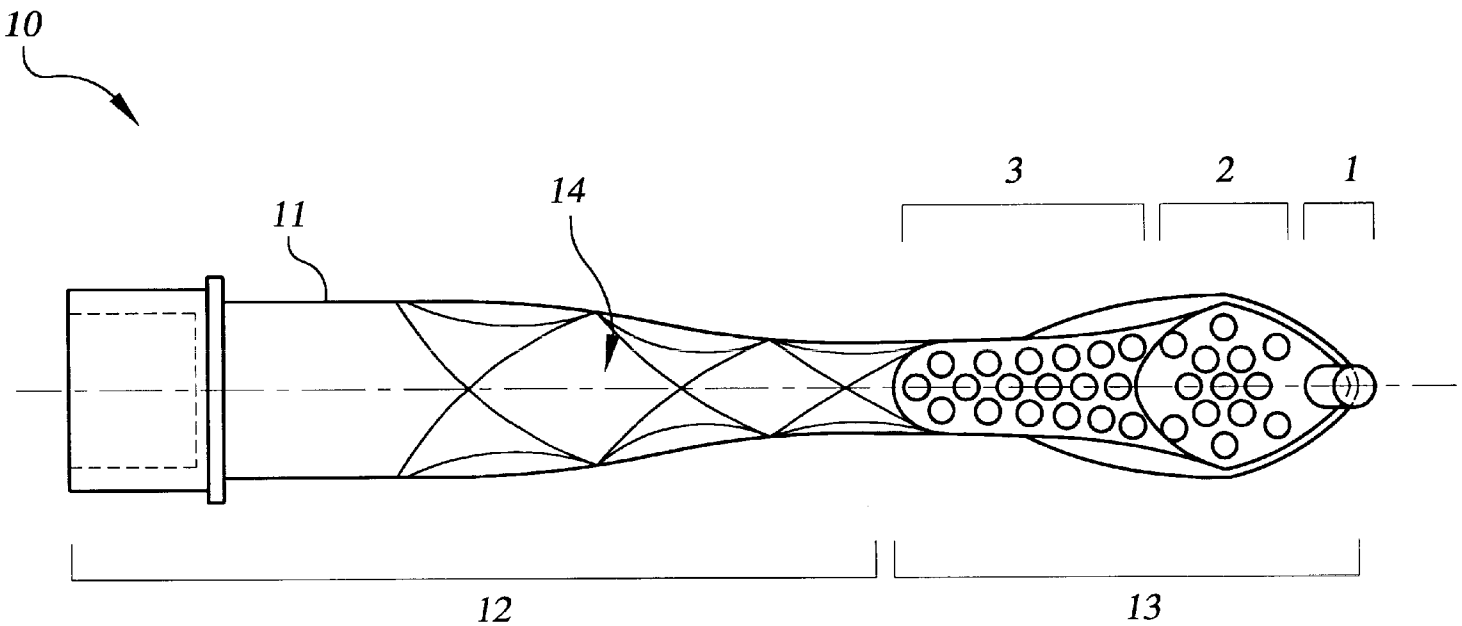
FIG. 1 is a top profile view of a preferred jewelry brush according to the present invention.
Figure 2:
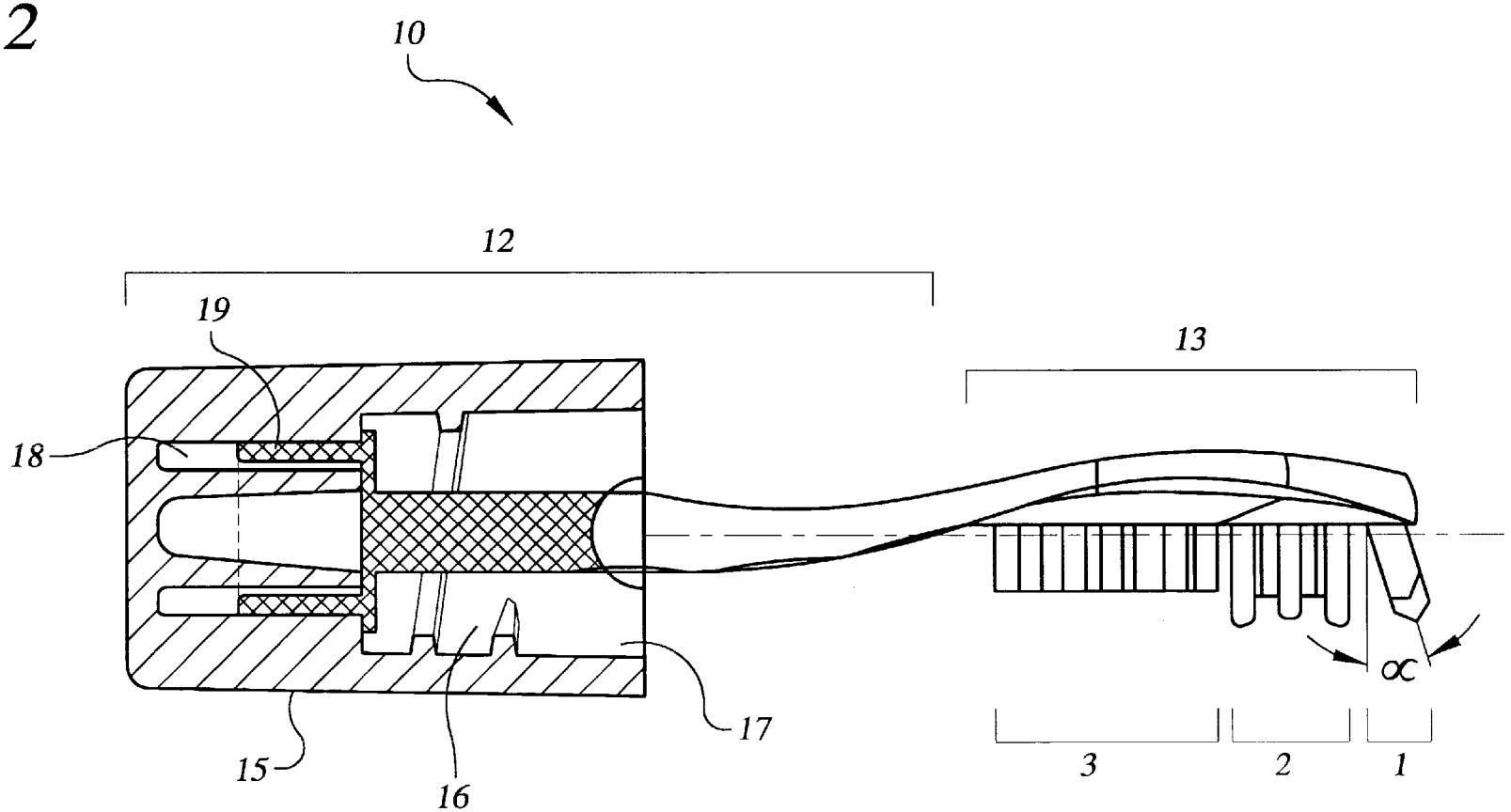
FIG. 2 is a side elevation view of a preferred jewelry brush according to the present invention, further incorporating a bottle cap portion.

FIGS. 1 and 2 illustrate a jewelry brush 10 having a shaft 11 having a handle portion 12 and a head portion 13. The shaft is formed from a plastic material selected for manufacturability via an injection molding process. The handle portion 12 is sized to allow a user to hold the brush and may further include a surface pattern 14 to allow a user to have a firmer grip on the handle during use. The head portion 13 is sized to allow mounting of the bristles.

As illustrated in FIG. 2, the handle portion may be further adapted to incorporate a cap 15 adapted to mate to a storage container (not shown). The cap portion 15 may he formed from the same material as the shaft 11, or may utilize a different material. The cap portion 15 include a port 17 sized to mate to the container. The port 17 includes a threaded portion 16 adapted as a screw down surface for mating and sealing the cap to the container. The brush 10 is joined to the cap 15 via a friction fit via collar 19 and channel 18. Alternatively, collar 19 and channel 18 may be joined through glue or ultrasonic welding.

Brush head 13 may be further divided into multiple zones, for instance three zones 1, 2 and 3. Each zone has one or more tufts of bristles mounted within each having different characteristics. The characteristics include variations in tuft material, tuft angle, tuft shape, tuft grouping shape, tuft trimming and tuft surface treatment. For example, as illustrated in FIG. 2, the brush head incorporates three zones 1, 2 and 3.

Zone 1—The Probe

Zone 1, illustrated in FIGS. 1 and 2, is the zone nearest the tip of the brush and is called the "probe." The present invention utilizes tufts throughout the brush, with a single tuft composed of multiple strands of monofilament nylon, of at least 15 count that ultimately yields 30 bristles after the strands are folded and inserted into the brush handle. Zone 1 may be composed of one to four small tufts in a tight pattern, or a single larger tuft.

In one preferred embodiment, Zone 1 bristles are set within the head portion 13 at an angle relative to the long axis of the shaft 11. The angle $\alpha$ is selected such that bristles in zone 1 point outward from the head, away from the other tufts on the brush, so as to facilitate the cleaning tight spaces, acting like a pick. The top of the zone 1 tuft of bristles has a knife-edge contour. An alternative embodiment utilizes a large single bristle rather than a tuft of fine bristles, having again a knife-edge contour.

The stiffness or firmness of the probe can be increased by 1) increasing the filament diameter, 2) increasing the filament count and thus tuft size, 3) shortening the tuft height, or 4) decreasing the angle $\alpha$ to make the probe more upright.

The stiffness or firmness of the probe can be decreased by 1) decreasing the filament diameter, 2) decreasing the filament count and thus tuft size, 3) lengthening the tuft height, 4) increasing the angle $\alpha$ to make the probe more upright, or 5) polishing the bristle ends.

Example 1 probe design:

| Single, large firm probe | |
|---|---|
| Trim Height | 0.320" |
| Tuft Diameter | 0.100" |
| Filament Diameter | 0.008" straight |
| Probe Angle | 15 degrees |
| Tuft Count | 1 |
| Distance Between Probe Center and Other Tufts | 0.167" |

Example 2 probe design:

| Single, large medium stiffness probe | |
|---|---|
| Trim Height | 0.320" |
| Tuft Diameter | 0.100" |
| Filament Diameter | 0.006" straight |
| Probe Angle | 15 degrees |
| Distance Between Probe Center and Other Tufts | 0.167" |

Example 3 probe design:

| Single, large soft probe | |
|---|---|
| Trim Height | 0.310" |
| Tuft Diameter | 0.100" |
| Filament Diameter | 0.005" straight |
| Probe Angle | 15 degrees |
| Distance Between Probe Center and Other Tufts | 0.167" |

Example 4 probe design:

| Single, small, medium stiffness probe | |
|---|---|
| Trim Height | 0.300" |
| Tuft Diameter | 0.060" |
| Filament Diameter | 0.007" straight |
| Probe Angle | 10 degrees |
| Distance Between Probe Center and Other Tufts | 0.167" |

Example 5 probe design:

| Single, small soft probe | |
|---|---|
| Trim Height | 0.300" |
| Tuft Diameter | 0.060" |
| Filament Diameter | 0.006" straight |
| Probe Angle | 10 degrees |
| Distance Between Probe Center and Other Tufts | 0.167" |

In some applications such as a large open back broach, it is advisable to use three small tufts in the probe instead of a single large one, since three small tufts will cover a larger opening in the jewelry with less applied force than a single, large tuft probe. The preferred design for a three-tuft probe is a pattern in a "V" shape with a 50 to 90 degrees included angle.

Zone 2—The Cup

A preferred embodiment of the invention includes zone 2, a gem "cup" between zone 1 and zone 3, as shown in FIGS. 1 and 2. Zone 2 is placed near zone 1 to be close to the end of the brush where it has greater cleaning access to gem stones and mounts. The cup is characterized by a concave surface formed by a unique arrangement of tufts and the trimming of the tufts within this zone.

Figure 4:
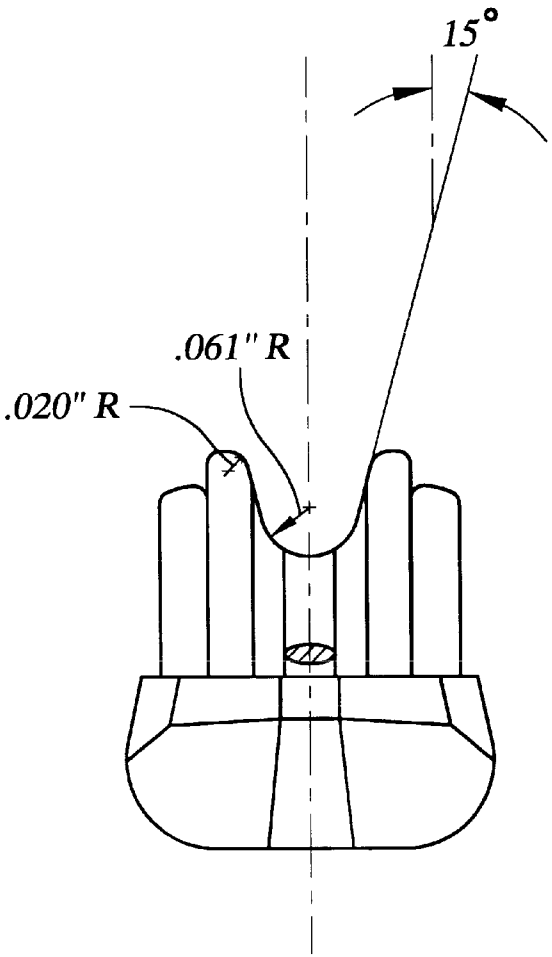
FIG. 4 is a cross section of zone 2 illustrated in FIG. 3.
Figure 3:
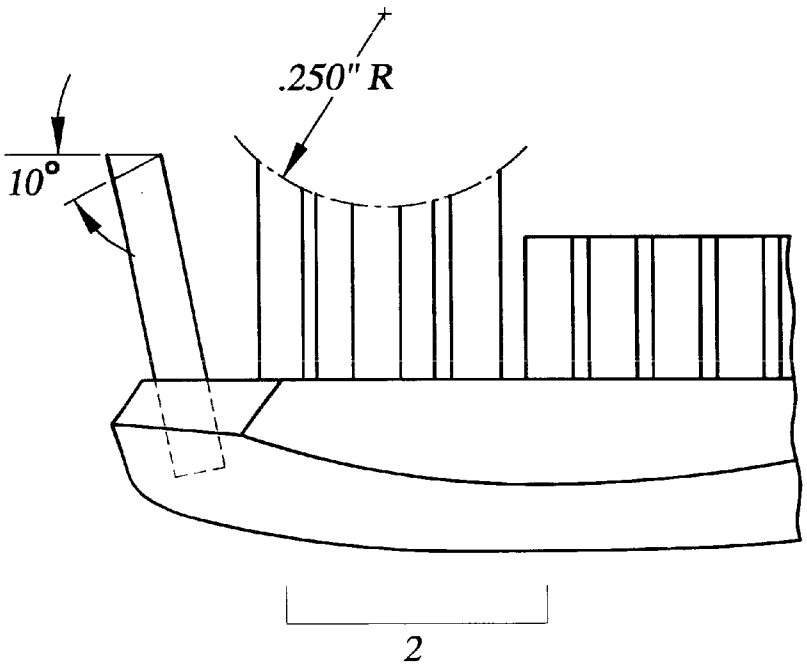
FIG. 3 is a side elevation view of zone 2 of the preferred jewelry brush according to the present invention.
Figure 5:
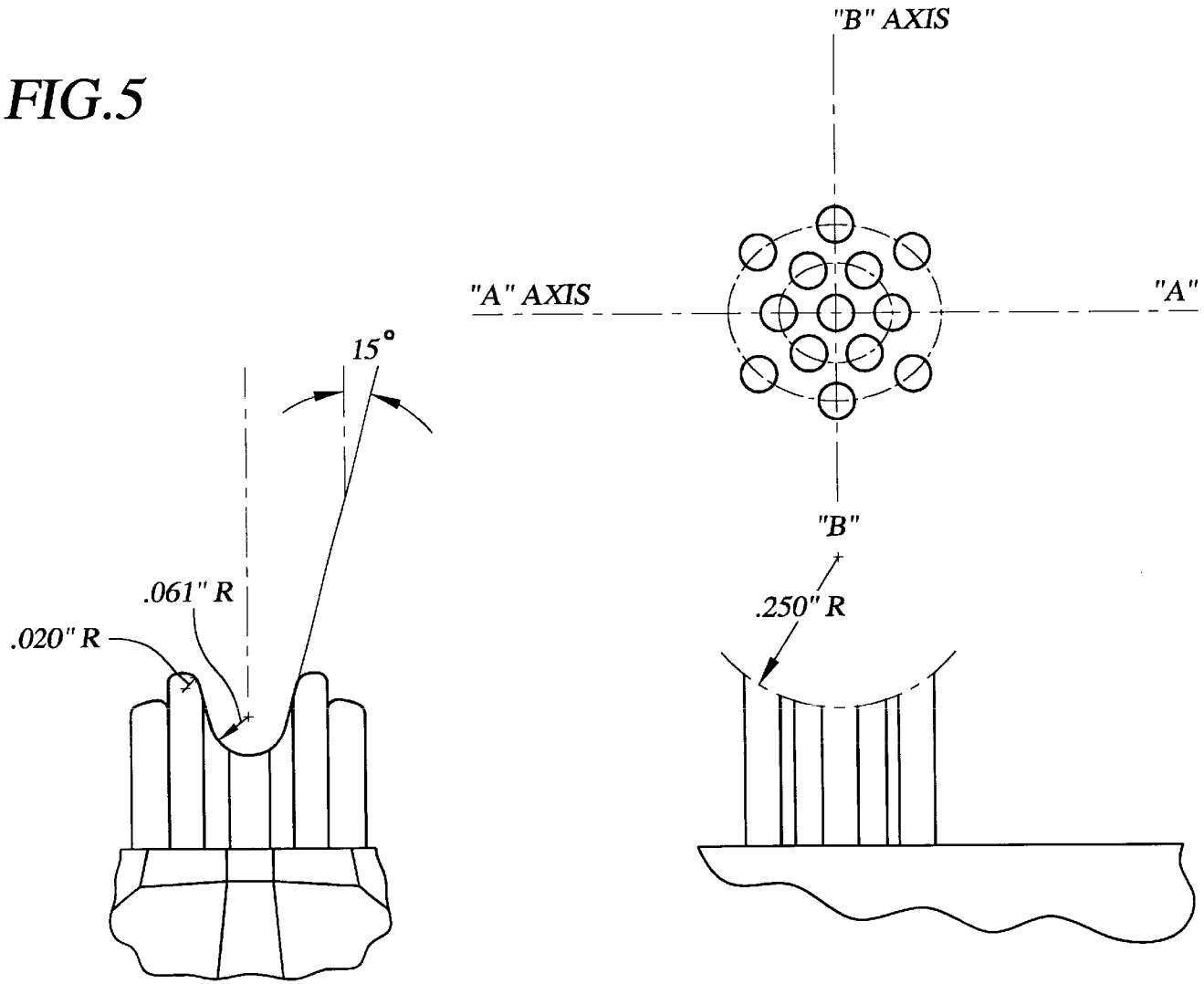
FIG. 5 is a top view of the tuft layout of zone 2 as further illustrated in FIGS. 3 and 4.
Figure 6:
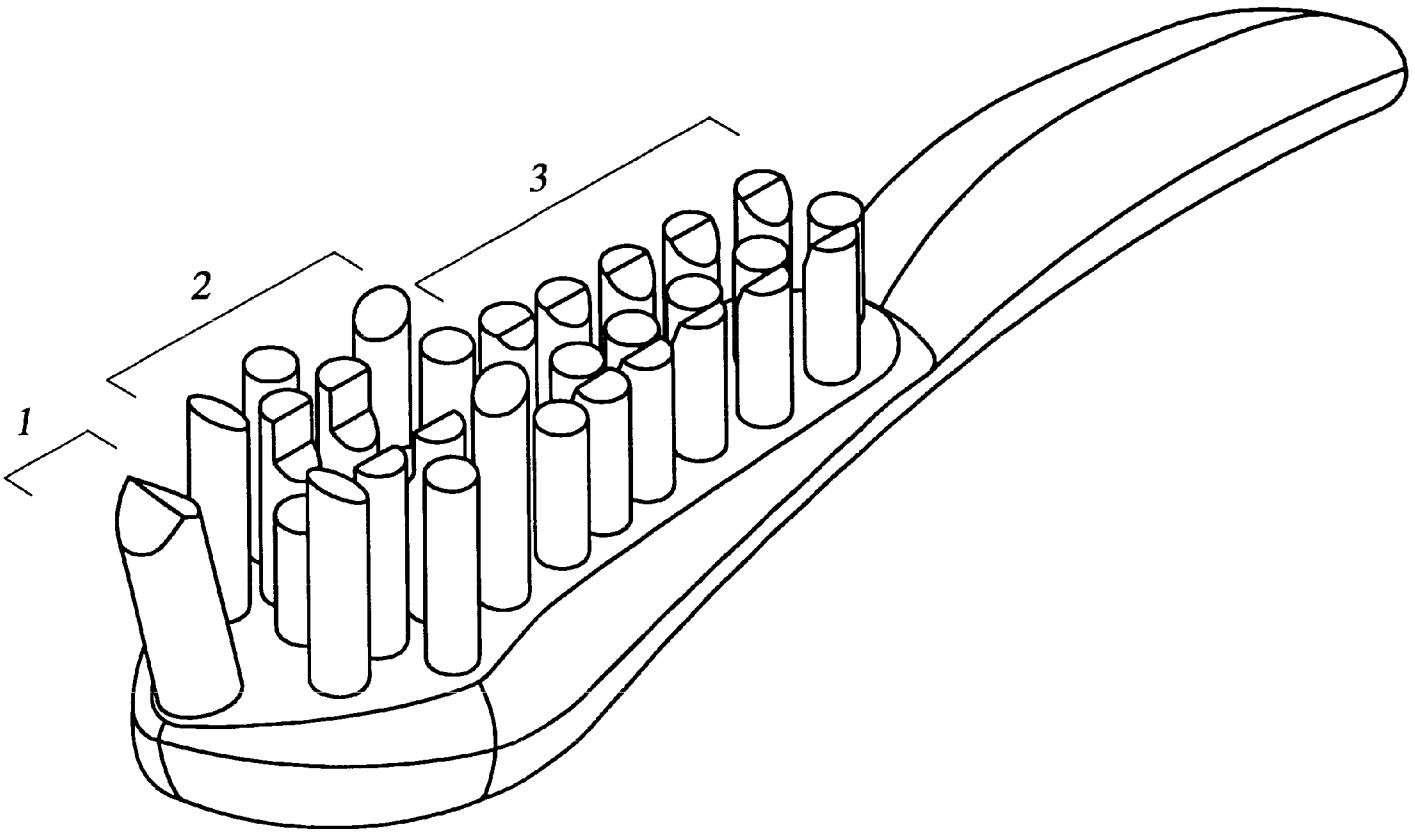
FIG. 6 is a perspective view of the head portion of the jewelry brush according to the present invention.

Turning to FIGS. 3, 4 and 5, zone 2 contains multiple tufts of bristles. While the number of bristle tufts can vary, the embodiment illustrated contains 13 bristle tufts. FIG. 5 illustrates one preferred embodiment utilizing two oval patterns of tufts arranged around a center tuft. The inner oval pattern has tufts uniformly distributed around the entire oval while the outer oval pattern has the tufts distributed in a pattern biased to one principal axis of the oval and substantially void along the other principal axis of the oval.

As noted, the tufts are trimmed, with each tuft contributing to the creation of the cup area within the center of the zone, as shown in FIGS. 3 and 4. The tuft trimming is performed along each principal axis, and may be trimmed to different depths and different radii. Thus, the outer ring of tufts are trimmed so as to slope downward toward the center of the overall group of bristle tufts. The inner bristle tufts are also trimmed so as to slope toward the center of the overall group. In the example illustrated, a single bristle tuft is placed at the overall center and trimmed provide the "base" to the cup. FIG. 3 illustrates the cross section of the zone 2 bristles, showing how the zone 2 bristles are arranged so as to cup a gemstone during cleaning.

Zone 2 is formed by a unique trimming of the bristles. Conventional bristling and trimming machines cut in only two directions, a two direction trim on a conventional brush will yield a cross pattern to the brush. In comparison, the present invention utilizes a unique pattern of tufts, the orientation of the tufts with respect to the trim path, and curvature of the trimmers that combine to give a smooth concave surface. As noted above, zone 2 tufts utilize an oval layout. The trim radius along the minor axis of the oval is sized based upon the dimension of the major axis, and the trim radius along the major axis of the oval is sized according to the dimension of the minor axis. The preferred trim radius is a ratio of trim radius to perpendicular axis of 0.1 to 1.0. While the shape of the trim is customarily concave, other shapes may be utilized.

Example 1 is a cup design utilizing a pattern of 0.060" tufts arranged around a center tuft in two ovals. An inner oval contains 6 tufts having axes of 0.168"×0.180". The outer oval contains 6 tufts having axes of 0.300"×0.338".

Example 2, illustrated in FIGS. 3 and 4, utilizes 0.060" diameter tufts arranged with a center tuft and 6 additional tufts arranged around the center tuft in an inner oval of 0.168"×0.180". In addition, an additional 6 tufts are arranged around the center tufts and inner oval as an outer oval of 0.300"×0.338". The outer oval tufts are biased toward the 0.300 axis (the "B" axis), with axis ratios of 1.07" and 1.27" respectively.

The tufts are trimmed along the "A" axis with a 0.06" radius with a 30 degree included angle and the tufts are trimmed along the "B" axis with a 0.25" radius, with a radius to axis ratios of 0.2 and 0.74 respectively.

In the special case where the ratio of the major axis dimension to the minor axis dimension is unity (1) then the oval is a circle. In this case, the selection of major and minor axes is arbitrary, and all other ratios and patterns will be relative to the major and minor axes once established.

Zone 3—The Groove

Many jewelry chains, braid necklaces and link bracelets are made primarily of interlocking links that are designed to distribute flexing and forces over several links, thereby effectively increasing the strength of the piece and creating a more gentle curve. Designs of chains and braids that distribute the flexing and forces consequently cause the piece to move and rotate in unison over a large section (4 to 10 diameters of interlocking links) whenever a force or bending is applied to a small, localized area. Traditional brushes are ineffective for cleaning these pieces because of the small contact area causes an area of the piece substantially longer than the brush to rotate and move away from the brush. Zone 3 provides the bristles directed to cleaning these long linear jewelry pieces.

Zone 3 contains a groove formed by orientation and trimming of the tufts. While the number of tufts can vary, one preferred embodiment, illustrated in FIGS. 1 and 8, zone 3 contains 18 bristle tufts. The tufts are arranged to create a somewhat linear pattern. The bristle tufts are trimmed so that each contributes to the creation of an indented area within the channel formed by the zone 3 tufts. The outer rows of bristle tufts are trimmed so as to slope downward toward the center of the row. The inner row of tufts is also trimmed so as to provide a flat "base" surface. FIG. 8A illustrates the cross section of the zone 3 tufts, showing how they are arranged to cup a linear jewelry section during cleaning.

Zone 3 is effective in cleaning and controlling flexible jewelry pieces due to two aspects of the design. First, the groove is long, approximating the bending length of a typical jewelry chain and braid. Second, the tuft pattern varies in spacing and pattern to preclude the chain from rolling between the tufts. A typical 2 mm diameter interlocked linked rope chain has a bending length of 8 mm and can only roll between the tufts of the brush if the gaps between the tufts are in a straight line, or the gapes between the tufts align with the tightly bent chain which is typically an "S" shape, 8 mm on each curve, 16 mm overall for the 2 mm rope chain.

Thus, in the preferred embodiments, the pattern of tufts in the groove section tapers from several tufts wide to one tuft less width over its length, generating an uneven pattern of gaps between the tufts and causing at least some tuft ends to support the "S" shaped chain. The tuft ends that support the rope chain on one spot will cause the chain to flex over a longer length and thus ramp the chain onto the other tuft ends when the chain and brush move relative to each other. This groove action causes the rope or braid to center ad straighten in the groove, thus enabling the brush to rapidly clean and penetrate the pieces irregularities.

The groove zone has the added feature of flat surface on the areas of the tufts that are not used in the groove channel, and are laterally positioned to the groove. The flat top tufts are used for cleaning large jewelry items that are flat or gently curved.

Zone 2 and Zone 3 Interaction

Figure 7:
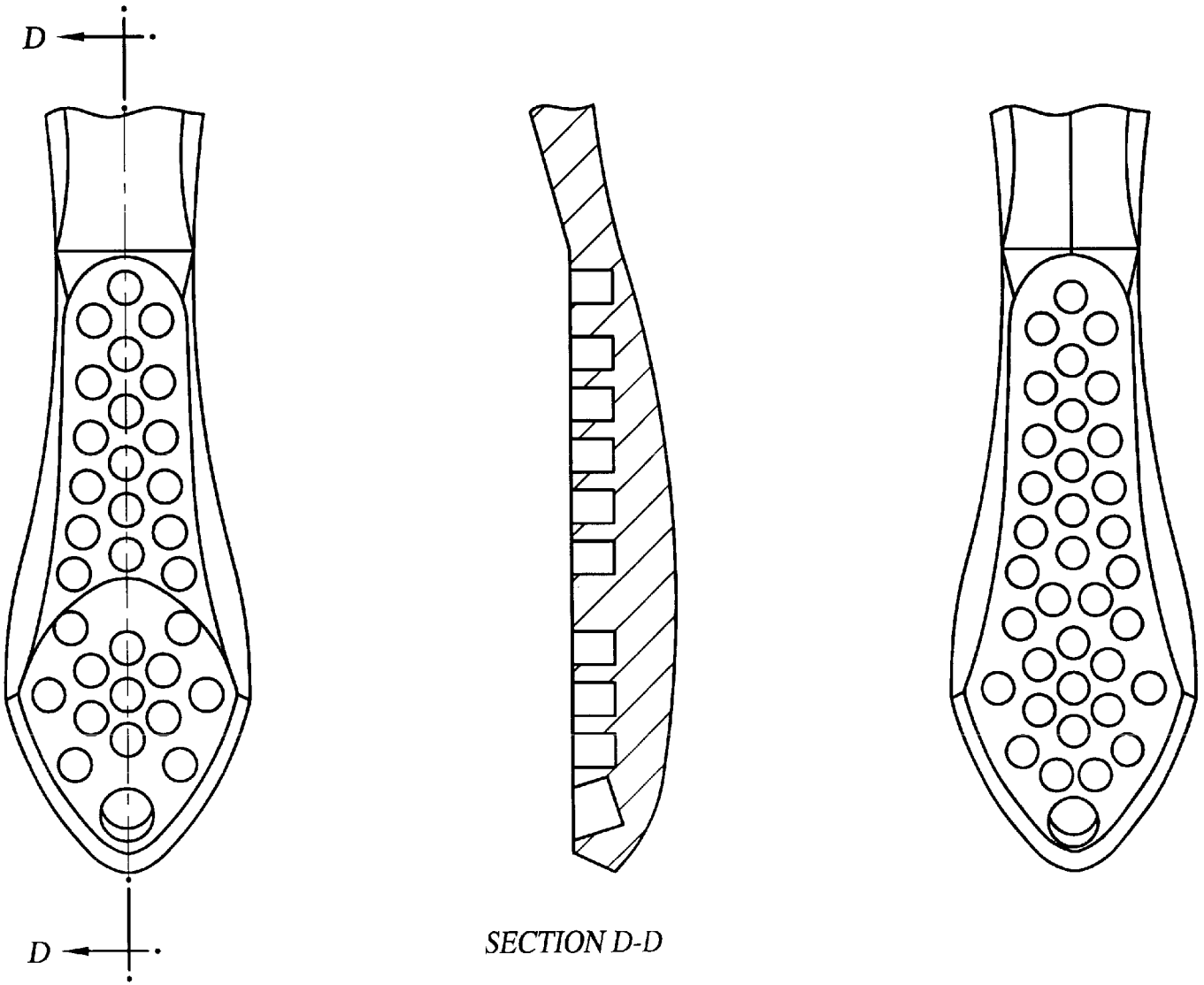
FIG. 7 illustrates orthogonal views of the head portion of the present invention.

The groove in zone 3 is on an axis of the cup in zone 2, as illustrated in FIG. 7. The line of lowest heights of the groove lien with the lowest heights of the cup on the axis, thus using the large sides of the cup shape as a funnel to locate and orient a chain into the groove and extending the length of the groove for cleaning.

Color Coding

In additional embodiments, each of the zones may be colored a separate color to provide an easily recognized key for the zone. The coloring of the zone 2 cup also provides a visual reference for the user when orienting the stone and the cup during cleaning.

Container

Figure 8:
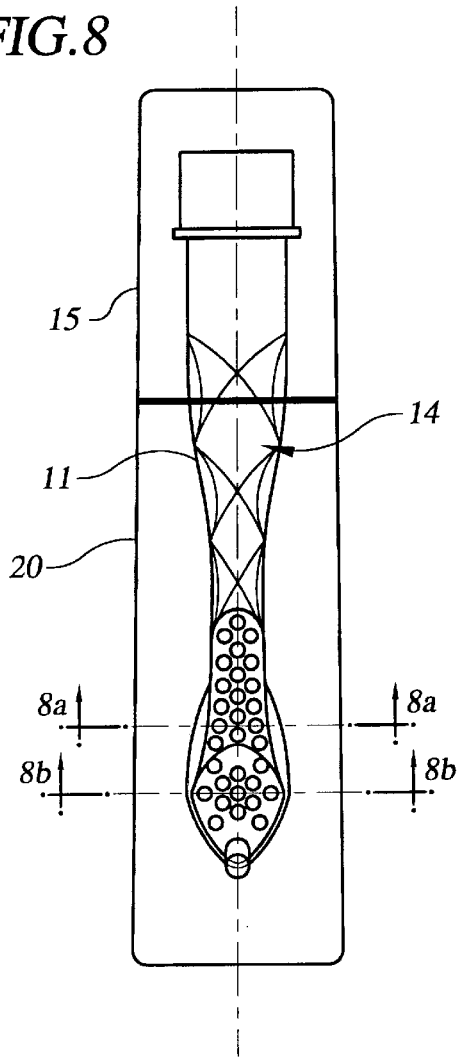
FIG. 8 is a top profile view of a preferred jewelry brush according to the present invention as mounted in a bottle sealed by the jewelry brush cap portion.
Figure 9:
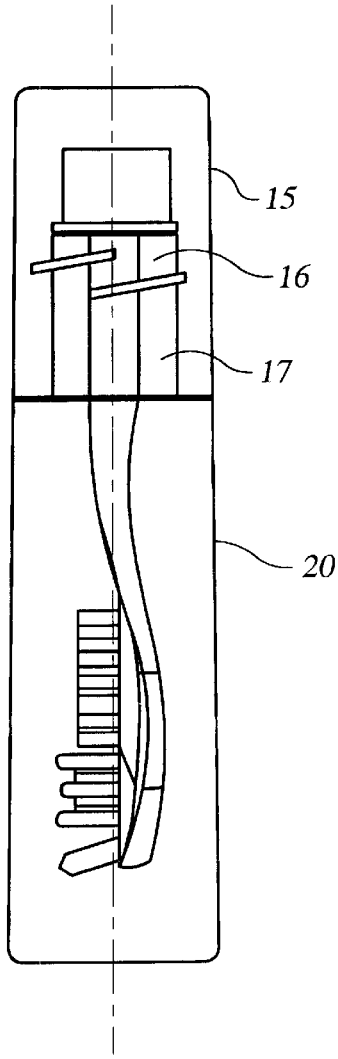
FIG. 9 is a side elevation view of a preferred jewelry brush of FIG. 8.
Figure 8A:
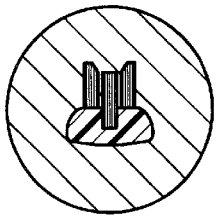
FIG. 8A is a cross sectional view of the jewelry brush of FIG. 8 through the 8A—8A Section.
Figure 8B:
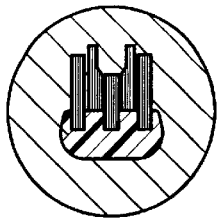
FIG. 8B is a cross sectional view of the jewelry brush of FIG. 8 through the 8B—8B Section.
Figure 9A:
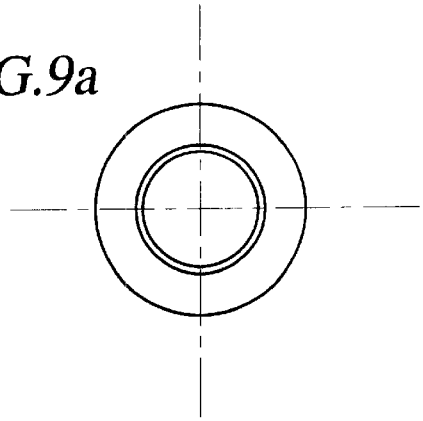
FIG. 9A is a top view of the cap portion of the jewelry brush of FIG. 9.

Turning to FIGS. 8, 9 and 9A, the brush of FIG. 2 (having the cap connected to the shaft) is illustrated mounted on a container 20. The container 20 is adapted to contain a fluid, for instance a jewelry cleaning fluid. In operation, the container 20 is held upright, the cap 15 with integral brush portion 13 is removed, and the brush portion 13 is applied to the jewelry piece. The bristles are designed to provide enough surface tension to retain a cleaning fluid within their interstitial spaces. When the user is done, the brush portion 13 can be returned to the bottle and the cap tightened to seal the container.

Materials and Fabrication

Commonly, bristles are left in their straight as trimmed state. In variation, the bristles can be crimped to impart a "Z" type pattern in each filament of the bristles to increase their stiffness, increase the spacing of the filaments if the tuft, and hence increasing the overall diameter of the tuft at the tip and thus the tuft surface area. Increased surface area can improve certain cleaning characteristics of the brush.

Additionally, the filament ends and side surfaces can be polished with an abrasive, typically a diamond-impregnated tool. The polishing removes sharp edges from the filament ends that are created in the trimming process, and textures the sides of the filaments. Filament sides that are textured in this manner have a matte appearance, are significantly more water wetable. Improved wetability is due to the decrease surface tension from the polishing. This improves the transfer of cleaning solution from the bottle to the jewelry piece for cleaning and also helps retain the cleaning fluid in the bristles during cleaning. In addition, the same action facilitates the rinsing process, where the excess cleaning solution and solubilized soils are displaced and removed.

The brush is manufactured utilizing any type of conventional injection molded process. The bristles are placed in the head and ultrasonically welded or stapled to the shaft. The bristles are made from a nylon material, and selected to provide the necessary resilience, not react to the selected cleaning fluid and provide a gentle cleaning action. While all bristles can be fabricated from the same material, each zone can utilize a different material for the tufts in that zone or even mix materials in the tufts for a zone, having different characteristics. Thus, each zone can be crafted by shape, angle and material to provide a particular cleaning surface.

Although particular embodiments of the present invention have been shown and described, modification may be made to the jewelry cleaning brush with departing from the teaching of the present invention. For example, bristles may be round or square in cross-section and may be polished to provide a smooth surface. In addition, zones 2 and 3 can be interchanged, or additional zones may be added. Accordingly, the present invention comprises all embodiments within the scope of the appended claims.

What is claimed is:

1. A jewelry brush comprising:

an elongated shaft including an elongated handle portion and an elongated head portion extending from an end of the handle portion, the head portion having a proximal end adjacent the handle portion and an opposite free distal end, wherein the handle and head portions are aligned along the longitudinal axis of the shaft; and a plurality of tufts of bristles extending from a top surface of the head portion, the plurality comprising:

a first zone of bristles at the distal end of the head portion, wherein the bristles of the first zone define an angle greater than 90 degrees relative to the longitudinal axis of the shaft and extend in a direction generally away from the handle portion and wherein the bristles of the first zone act as a pick and facilitate the cleaning of tight spaces;

a second zone of bristles adjacent said first zone, wherein the second zone of bristles comprises a plurality of bristle tufts extending generally perpendicular to the longitudinal axis of the shaft, and wherein the free ends of the bristles of the second zone define a concave cup-shaped surface for cleaning access to gem stones and mounts; and a third zone of bristles adjacent the second zone, wherein the third zone of bristles comprises a plurality of bristle tufts extending generally perpendicular to the longitudinal axis of the shaft, and wherein the bristle tufts of the third zone extend along the length of the head portion from the second zone to the proximal end thereof and define an elongated concave groove extending along the length of the head portion from the second zone to the proximal end of the head portion, said groove facilitating the cleaning of flexible jewelry pieces.

2. The jewelry brush of claim 1, wherein the zones have tufts of different stiffness.

3. The jewelry brush of claim 1, wherein the handle portion is adapted and constructed to mate with a storage container.

* * * * *